US005526885A

United States Patent [19]

Kuvshinov et al.

[11] Patent Number: 5,526,885

[45] Date of Patent: Jun. 18, 1996

[54] HYDRAULIC DEVICE FOR DRIVING PILES

[75] Inventors: Viktor A. Kuvshinov; Vladimir M. Ermolaev; Sergei V. Rusin; Vyacheslav A. Goldobin, all of Novosibirsk, Russian Federation

[73] Assignee: Aktsionernoe obschestvo zakrytogo tipa "Rossiiskaya Patentovannaya Tekhnika" (ROPAT), Novosibirsk, Russian Federation

[21] Appl. No.: 387,839

[22] PCT Filed: Aug. 19, 1992

[86] PCT No.: PCT/RU92/00161

§ 371 Date: Feb. 17, 1995

§ 102(e) Date: Feb. 17, 1995

[87] PCT Pub. No.: WO94/04762

PCT Pub. Date: Mar. 3, 1994

[51] Int. Cl.[6] ..... E02D 7/10

[52] U.S. Cl. ..... 173/17; 173/207

[58] Field of Search ..... 173/13, 15, 16, 173/17, 206, 207, 208

[56] References Cited

U.S. PATENT DOCUMENTS

| | | | |
|---|---|---|---|
| 3,035,548 | 5/1962 | Wittlich | 173/207 |
| 3,207,043 | 9/1965 | Kay | 173/17 |
| 3,608,650 | 9/1971 | Matsusaka | 173/207 |
| 4,052,107 | 10/1977 | Hay | 173/207 |
| 4,429,751 | 2/1984 | Jackson et al. | 173/13 |
| 5,117,921 | 6/1992 | Bartels et al. | 173/13 |
| 5,152,352 | 10/1992 | Mandanis | 173/17 |

FOREIGN PATENT DOCUMENTS

| | | |
|---|---|---|
| 0388497 | 9/1990 | European Pat. Off. . |
| 0388498 | 9/1990 | European Pat. Off. . |
| 3007103 | 9/1980 | Germany . |
| 1086071 | 4/1984 | U.S.S.R. . |
| 1479570 | 5/1989 | U.S.S.R. . |
| 1244635 | 9/1971 | United Kingdom . |

*Primary Examiner*—Scott A. Smith
*Attorney, Agent, or Firm*—Collard & Roe

[57] ABSTRACT

A hydraulic device for driving piles including a casing accommodating a striker with an anvil block, a hydraulic power cylinder, having a rod connected to the striker and a hydraulic directional control selector. A control unit is separated from the directional control selector and is secured on a housing of the power cylinder coaxially with the striker. The hydraulic directional control selector comprises two valves, each of which is provided with two pilot chambers, communication pairwise with each other. The first valve puts the head end of the power cylinder in communication with the rod end, and the second valve establishes communication between the head end and the return flow line.

8 Claims, 5 Drawing Sheets

HYDRAULIC DEVICE FOR DRIVING PILES

TECHNICAL FIELD

The present invention relates to construction machines, and, particularly, to a hydraulic device for driving piles.

DESCRIPTION OF THE ART

Known in the art is a hydraulic device for driving piles, comprising a housing, accommodating a striker mounted with a possibility of reciprocating therein and interacting with an anvil block mounted coaxially therewith in the housing (DE, A,2 900221). Mounted on the housing coaxially to the striker is a hydraulic power cylinder whose rod is connected to the striker with its one end, whereas the other end thereof is connected to the piston which divides the hydraulic power cylinder into a rod end and a head end. The rod end is in constant communication with a pressure flow line. The head end through a spool-type hydraulic directional control valve alternatively communicates with a pressure flow line and a return flow line.

The control unit of the hydraulic directional control valve comprises a pilot cylinder defined by the internal surface of the spool space which communicates through a pressure relief valve with the return flow line, and a plunger mounted in this space and adapted for reciprocating therein, one end of the plunger interacting with the rod of the power cylinder.

The known hydraulic device for pile driving is highly reliable and durable. However, in the structure disclosed the instant of reversal in the lower position with respect to the instant of collision of the striker and the anvil block cannot be exactly registered and adjusted, which makes the instant of switching with respect to the stroke position unstable, and consequently, reduces the efficient use of the kinetic energy of the striker, and the effect of pile driving.

Moreover, the adjustment of the impact energy performed using additional means, for instance, electromagnetic device for changing the stroke length of the accumulating cylinder piston, and therefore, volume of the accumulating cylinder. This is done on command of the operator, that is, manually; this cannot provide an optimum energy impact for an adequate operation of the device, which reduces its efficiency.

As is known, the spool-type systems require precision machining of rather large surfaces of the members to be joined and are not adapted for use of low-viscosity liquids as a working fluid, such as, for example, water, so as to avoid an inadmissible increase in leaks.

Moreover, the use of the spool-type directional control valve causes "short-circuiting" of power cylinders, that is, with the spool in a definite position, the head end and the rod end of the power cylinder appear in communication with each other, which causes loss of the working fluid and reduces the efficiency of the hydraulic drive by 20–25%.

SUMMARY OF THE INVENTION

It is an object of the present invention to provide a hydraulic device for driving piles having such a structure of the directional control selector that considerably increases the efficiency of the pile driving operation and renders it possible to use, as a working fluid, low-viscosity liquids, preferably water, while enhancing the efficiency of the device.

The object of the invention is accomplished in a hydraulic device for driving piles, comprising a housing accommodating, with a possibility of reciprocating, a striker interacting with an anvil block coaxially arranged in the housing, and a hydraulic power cylinder installed on the housing coaxially with the striker. The rod of the power cylinder is connected with one its end to the striker, and with the other end, to the piston which divides the hydraulic power cylinder interior into a rod end which is in constant communication with a pressure line, and a head end which is in alternating communication with the rod end and a return flow line through a hydraulic directional control selector. The control selector has a control unit which comprises a pilot cylinder having its interior in communication with the return flow line through a pressure relief valve, and a plunger installed in the interior of the pilot cylinder for reciprocating therein, which has one end interacting with the power cylinder rod. The control unit is separated from the directional control selector and is secured to the casing of the hydraulic power cylinder coaxially with the striker, and the directional control selector comprises two valves, of which the first valve is adapted for bringing the head end of the power cylinder in communication with the rod end, and the second valve establishes communication between the head end and the return flow line. Each valve has two pilot chambers communicating pairwise with each other, the first pair of the chambers closing the first valve and opening the second valve being in communication with the return flow line and, through a first control valve interacting at the end of the working stroke with the power cylinder piston, with the pressure line, whereas the second pair of chambers, opening the first valve and closing the second valve, communicates with the interior of the pilot cylinder.

Provision of the pilot cylinder and the plunger which are separated from the directional control selector makes it possible to dispense with the spool-type directional control valve, and to employ the valve-type directional control selector whereby a low-viscosity working fluid can be employed, for instance, water. The use of the valves as compared to the spool-type arrangement of the state-of-the art device permits the pressure to be increased due to the absence of leaks, since the higher the pressure, the tighter the valves are pressed in any extreme position. The valves are changed over by virtue of a pilot pressure pulse. Thus, in the proposed device, the valves are changed over by virtue of a pressure pulse in the pilot cylinder built up due to the action of the power cylinder rod onto the plunger.

To ensure successive operation of the valves and eliminate their "short-circuiting", it is necessary that, in the first pair of chambers, the cross-sectional area of the first valve chamber is larger than the cross-sectional area of the second valve chamber, whereas in the second pair of chambers, the cross-sectional area of the second valve chamber is larger than the cross-sectional area of the first valve chamber.

It is advisable that the pilot cylinder internal chamber be in communication with the return flow line through a first throttle installed parallel to a pressure relief valve, and with the pressure line, through a second control valve interacting with the anvil block.

This structural arrangement permits the length of the striker working stroke to be increased with each subsequent cycle and, at the same time, limits the maximum working stroke of the anvil block, which means that if the amount of the pile driving exceeds that required in the operation, the working stroke of the power cylinder piston is diminished, whereby the impact energy decreases, and, on the contrary, as the pile resistance increases, the power cylinder develops the impact energy to a maximum value. Thus, the impact energy depends on the pile driving depth per working stroke.

To prevent the hydraulic device from destruction, it is necessary to provide an emergency valve adapted for interaction with the anvil block and arranged parallel to the second pilot valve.

To make the change-over operation of the second valve slower and thus prevent the contacting surfaces from impact loads, it is expedient that in the second pair of the chambers, the second valve chamber be brought in communication with the pilot cylinder internal chamber through a second throttle.

Advantageously, the inner end face of the pilot cylinder facing the inlet port is provided with a spring, the internal chamber of the pilot cylinder being brought in communication with the return flow line through a non-return valve.

This structural arrangement helps avoid collision of the hydraulic power cylinder head and the rod caused by the return stroke the rod, since the spring brings back the plunger of the pilot cylinder into a definite position, whereby the working fluid is sucked in from the return flow line through the non-return valve, thus preventing an increase of the piston working stroke.

To bring down the pressure in the pilot cylinder internal chamber when the power cylinder operates for the working stroke, and consequently, to reduce metal consumption necessary for the members constituting the control unit, and to render the operation of movable seals easier, preferably, the first pair of the pilot chambers be in communication with the return flow line through a third control valve whose pilot chamber communicates with the pilot cylinder interior space.

Advantageously, the hydraulic device is provided with a third throttle and a fourth control valve successively arranged and adapted for putting in communication the first pair of the pilot chambers with the head end of the hydraulic power cylinder, the pi lot chamber of the fourth control valve communicating through the first control valve with the pressure line.

This ensures a reliable change over of the hydraulic device to the "cocked-up position" (idle stroke) when driving piles in stiff soil, in cases where, due to the striker rebound, the first control valve is open but for a short period of time.

For a routine intervention into the automatic operation of the hydraulic device for driving piles, it is necessary to establish communication between the pilot cylinder interior and the return-flow and pressure lines through an additional directional control selector mounted in series with the first throttle.

The hydraulic device for driving piles according to the invention features the efficiency by 20–25% higher than that of a similar device wherein use is made of a spool-type directional control valve, which enhances the efficiency with the same drive power. The proposed device is ecologically pure, since used as a working fluid is water, sea water inclusive, rather than mineral oil which is typical for the state-of-the art device. It is extremely important in view of the fact that the device is adapted for use in construction carried out in coastal areas and on the sea shelf, where environmental contamination is quite undesirable or inadmissible. Moreover, provision is made in the proposed structural arrangement of the hydraulic device for automatic adjustment of the impact energy, which is also conducive to enhance the efficiency of the pile driving, whereas the manual adjustment does not ensure optimum impact conditions for pile driving. The device of the invention is highly reliable in operation due to the provision of an automatic system for preventing emergency situations, which allows instantaneous reduction of the impact energy to minimum in cases where the driving depth exceeds the optimum value required, and also due to the fact that it is insensitive to the working fluid pollution. The proposed device is cheaper in manufacture due to the improved technological effectiveness which does not require high precision machining.

BRIEF DESCRIPTION OF THE DRAWINGS

The present invention will be better understood by reference to the following detailed description when considered in connection with the accompanying drawings wherein.

DESCRIPTION OF THE PREFERRED EMBODIMENT

Figure 1:
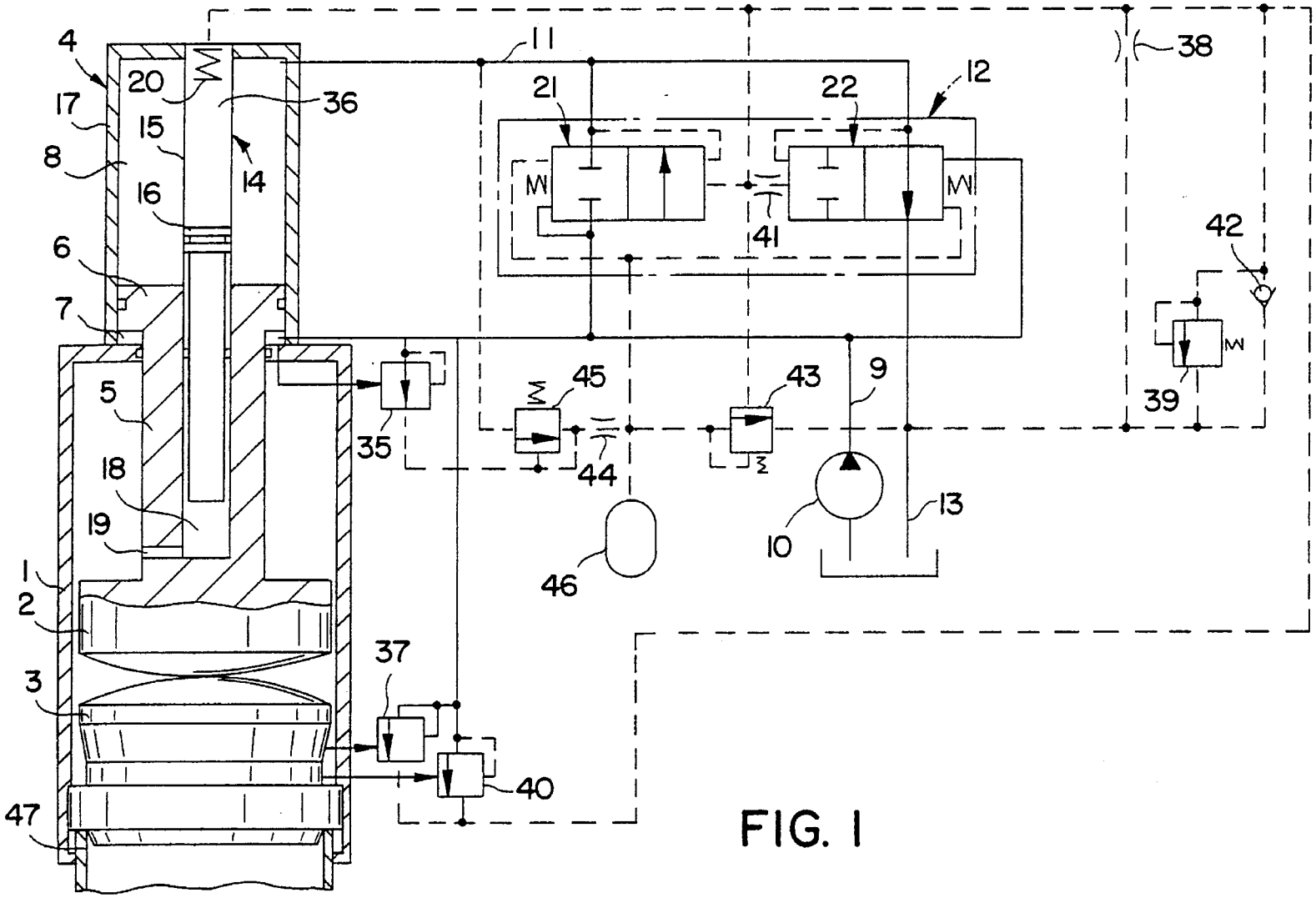
FIG. 1 illustrates a device for driving piles, according to the invention, while in the initial position.

The hydraulic device for driving piles, according to the invention, comprises a housing 1 (FIG. 1) which accommodates a striker 2 mounted with a possibility of reciprocating and interacting with an anvil block 3 coaxially arranged in the housing 1. Installed on the housing coaxially with the striker 2 is a hydraulic power cylinder 4. A rod 5 of the hydraulic power cylinder 4 is connected to the striker 2 with its one end, whereas the other end thereof is connected to a piston 6 which divides the interior of the power cylinder 4 into a rod end 7 and a head end 8. The rod end 7 is in constant communication through a pressure line 9, with a pump 10. The head end 8 communicates with a hydraulic directional control selector 12 through a piping 11, said directional control selector being adapted for establishing communication between the head end 8 either with the rod end 7 or with a return flow line 13.

The hydraulic device is provided with a control unit 14 to effect monitoring of the directional control selector 12, the control unit comprising a pilot cylinder 15 and a plunger 16 reciprocatingly mounted therein. The control unit is separated from the hydraulic directional control selector 12 and is essentially a quickly-detachable unit which is fixed to a casing 17 of the hydraulic power cylinder 4 coaxially with the striker 2, the pilot cylinder 15 being received by a bore 18 made in a kinematic pair, that is the rod 5—the piston 6, thus forming a sliding sealed couple therewith. The bore 18 communicates with the surrounding medium through a drain hole 19. One end face of the plunger 16 interacts with the rod 5 of the power cylinder 4. To avoid collision of the rod 5 and the head of the power cylinder 4, the interior end face of the pilot cylinder 15 facing the inlet, is provided with a spring 20.

The hydraulic directional control selector 12 is made as two valves 21 and 22, of which the first one is adapted for bringing the head end 8 of the power cylinder 4 in communication with the rod end 7, whereas the second valve 22 establishes communication between the head end 8 and the return flow line 13. The valves 21 and 22 have rods 23, 24, respectively (FIG. 2) with respective pistons 25, 26 and hydraulically operated springs 27, 28. The rods 23, 24 are smaller in diameter than valve seats 29, 30, respectively, so that when in the closed position both valves 21, 22 are held by a force equal to the product of a working pressure p by the difference between the cross-sectional area of the seat 29 (30) and the rod 23 (24). The pistons 25 and 26 divide the cylinders accommodating them into pilot chambers 31, 32, 33 and 34 which are in pairwise communication with one another. The first pair of the chambers 31 and 34 closing the first valve 21 and opening the second valve 22, communicates with the return flow line 13 (FIG. 1), and, through first control valve 35, which interacts at the end of the working stroke with the piston 6of the hydraulic power cylinder 4, with the pressure line 9. The second pair of the chambers 32, 33 (FIG. 2) which open the first valve 21 and close the second valve 22, communicates with an interior chamber 36 (FIG. 1) of the pilot cylinder 15.

To ensure successive operation of the valves 21 and 22 in the first pair of the chambers 31, 34 (FIG. 2), the cross-sectional area of the chamber 31 of the first valve 21 is made larger than that of the chamber 34 of the second valve 22. In the second pair of the chambers 32, 33 the cross-sectional area of the chamber 33 of the second valve 22 is made larger than that of the chamber 32 of the first valve 21.

An automatic change of the impact energy is effected due to the fact that the chamber 36 (FIG. 1) of the pilot cylinder 15 communicates with the pressure line 9 through a second control valve 37, mounted in the anvil block section of the housing 1 with a possibility of interaction with the anvil block 3, or with another movable member of the device, the chamber 36 of the pilot cylinder 15 communicating with the return flow line 13 through a first throttle 38 mounted in parallel with a pressure relief valve 39.

To avoid emergency situations, an emergency valve 40 is provided which is mounted parallel to the second control valve 37 and is adapted for interacting with the anvil block 3.

The contact surfaces of the valves 21, 22 are protected from impact loads by slowing down the change over of the second valve 22, which is effected due to the fact that in the second pair of the chambers 32, 33 (FIG. 2) the chamber 33 of the second valve 22 communicates with the chamber 36 (FIG. 1) of the pilot cylinder 15 through a second throttle 41, whereas the first pair of the chambers 31, 34 (FIG. 2) communicates with the pressure line 9 (FIG. I) and the head end 8, through a throttle 44.

A maximum working stroke of the piston 6 of the hydraulic power cylinder 4 is ensured by the fact that the chamber 36 of the pilot cylinder 15 communicates with the return flow line 13 through a non-return valve 42.

To reduce pressure in the chamber 36 of the pilot cylinder 15 when the power cylinder 4 is changed over to the "working stroke", and thus to decrease metal consumption of the members constituting the control unit 14 and facilitate operating conditions of the movable seals, the first pair of the pilot chambers 31, 34 (FIG. 2) of the valves 21, 22 communicates with the return flow line 13 (FIG. 1) through a third control valve 43 whose pilot chamber communicates with the chamber 36 of the pilot cylinder 15.

To adjust the operation rate and to ensure reliable operation of the valves 21, 22 of the directional control selector 12, the first pair of the pilot chambers 31, 34 (FIG. 2) of the valves 21, 22 communicates with the head end 8 (FIG. 1) through series-connected the third throttle 44 and a fourth control valve 45, as well as with a hydraulic accumulator 46. The pilot chamber of the fourth control valve 45 communicates with the return flow line 9 through the first control valve 35.

The hydraulic device for driving piles, according to the invention, operates as follows.

With the device in the initial position the device operates vertically or close to that) the piston 6 with the rod 5 occupy the lowermost position. Under the action of the hydraulically operated springs 27, 28 (FIG. 2) the valves 21 and 22, respectively, are in the initial position (the valve 21 is closed and the valve 22 is open), whereby the head end 8 (FIG. 1 ) of the power cylinder 4 is in communication, through the valve 22 of the directional control selector 12, with the return flow line 13. The third control valve 43 and the fourth control valve 45 are closed, whereas the first control valve 35 is open. The hydraulic accumulator 46 is not charged.

The working pressure is delivered from the pump 10 and is applied through the pressure line 9 to the rod end 7 of the hydraulic power cylinder 4 and to the hydraulically-operated springs 27, 28 (FIG. 2) of the valves 21 and 22 of the hydraulic directional control selector 12, thereby holding them in the initial position. Moreover, the working fluid is supplied, through the first control valve 35 (FIG. 1), to the first pair of the pilot chambers 31, 34 (FIG. 2) of the valves 21, 22 and thus causes the valves to assume the initial position (in case they occur, for some reason, in another position). The first valve 21 is held in the closed position.

Under the action of the pressure in the rod end 7 (FIG. 1), the piston 6 with the rod 5 start to moving upwards, thus forcing the fluid out from the head end 8 of the hydraulic power cylinder 4 through the second valve 22, to the tank, until the plunger 16 of the pilot cylinder 15 thrusts against the bottom of the bore 18 in the rod 5. Then the rod 5, the piston 6, and the plunger 16 of the pilot cylinder 15 move jointly upwards. In doing so, the plunger 16 of the pilot cylinder 15 forces the fluid located in the chamber 36 thereof to the second pair of the pilot chambers 32, 33 (FIG. 2) of the valves 21, 22, and to the pilot chamber of the third control valve 43.

Figure 2:
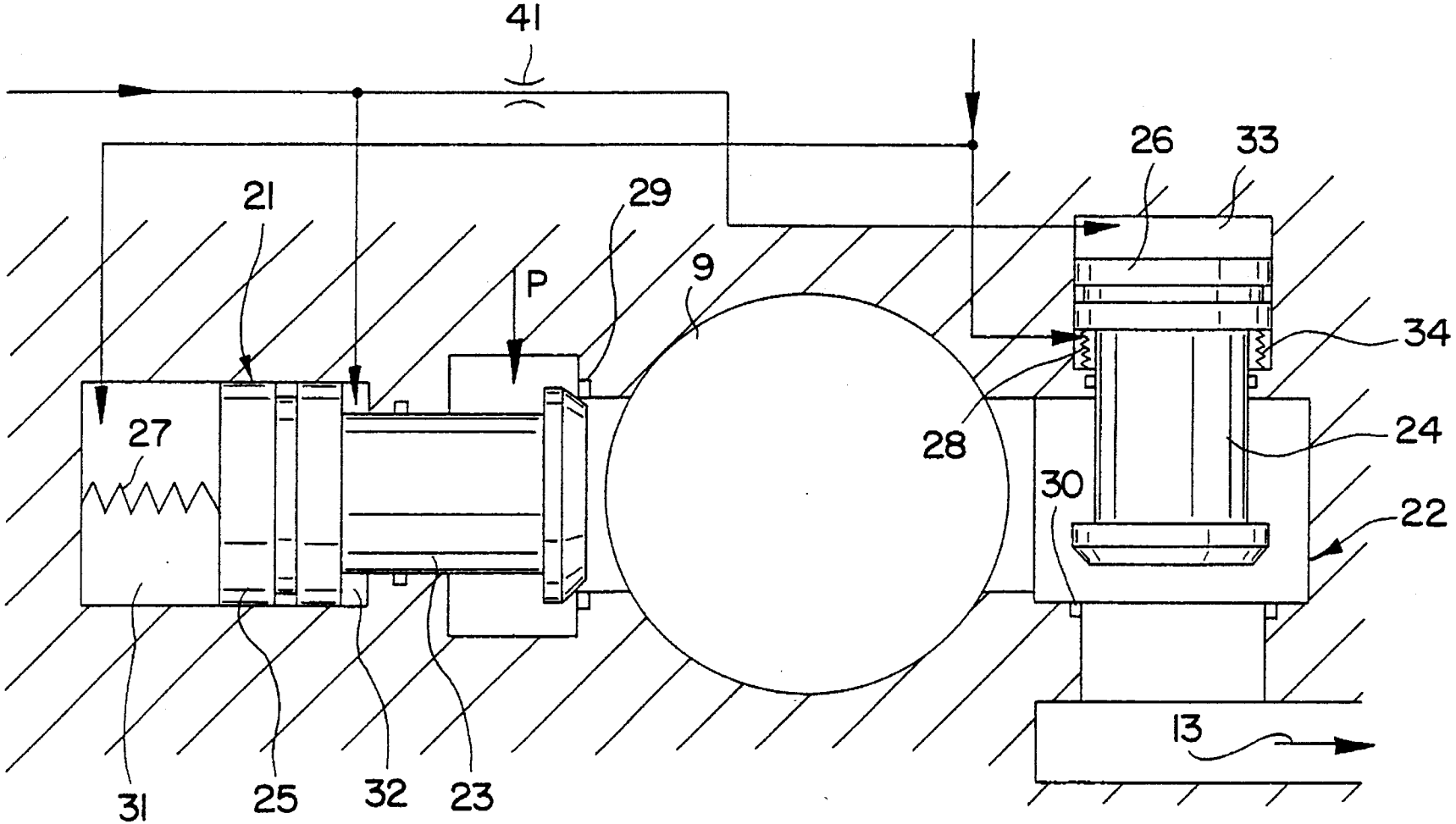
FIG. 2 shows a directional control selector, according to the invention.
Figure 3:
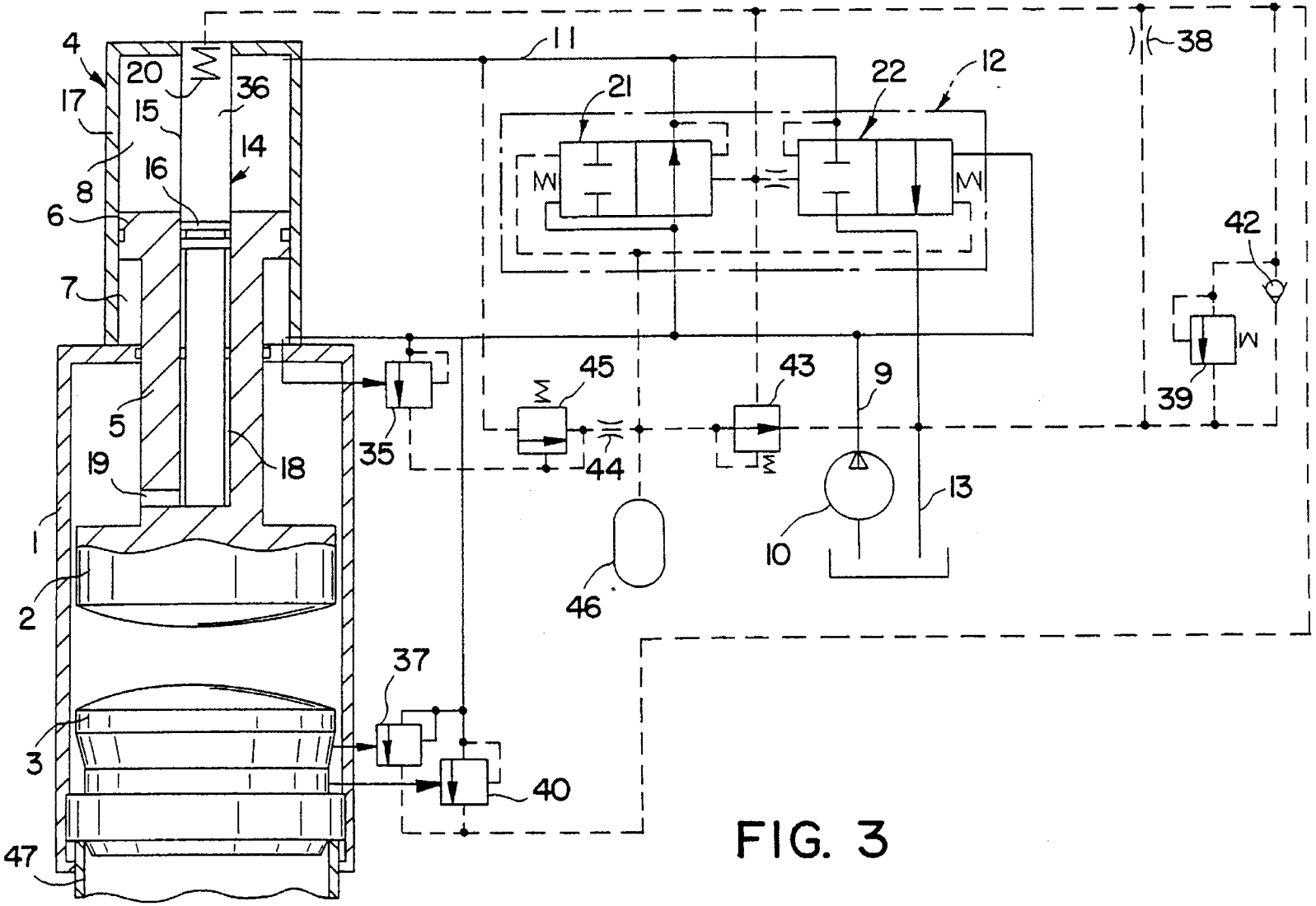
FIG. 3 shows the moment of reversal in the pile driving device, according to the invention.

As the pressure in said members rises, they start operating alternately. First, the third control valve 43 operates to bring in communication the first pair of the pilot chambers 31, 34 (FIG. 2) of the valves 21, 22 and the return flow line 13 (FIG. 1). When a sufficient pressure rise is attained for the second valve 22 to operate, it isolates the head end 8 of the power cylinder 4 from the return flow line 13. The piston 6, which continues its travel, compresses the fluid confined in the head end 8, which blocks the second valve 22 of the hydraulic directional control selector 12 in the closed position and acts upon the end face of the first valve 21. As soon as the total force of this pressure and the pressure in the chamber 32 (FIG. 2) of the first valve 21 reaches an adequate value, the first valve 21 operates to open, and brings in communication the head end 8 (FIG. 3) with the pressure line 9 (i.e., with the rod end 7).

The working fluid under pressure is admitted to the head end 8 of the power cylinder 4 and blocks the first valve 21 of the hydraulic directional control selector 12 in the open position. It is due to the difference between the areas (of the rod end and the head end) that the piston 6 with the rod 5 is decelerated to a standstill. Thus, the working stroke starts.

At the overtravel of the piston 6 of the power cylinder 4,the fluid is forced out from the pilot cylinder 15, through the pressure relief valve 39 and flows to the return flow line 13.

In the course of the working stroke the piston 6 moves downwards and becomes released from the plunger 16 which remains in the position assumed during the upward travel of the piston 6. The pressure in the chamber 36 of the pilot cylinder 15 drops and the third control valve 43 returns to the initial position under the action of the spring.

Figure 4:
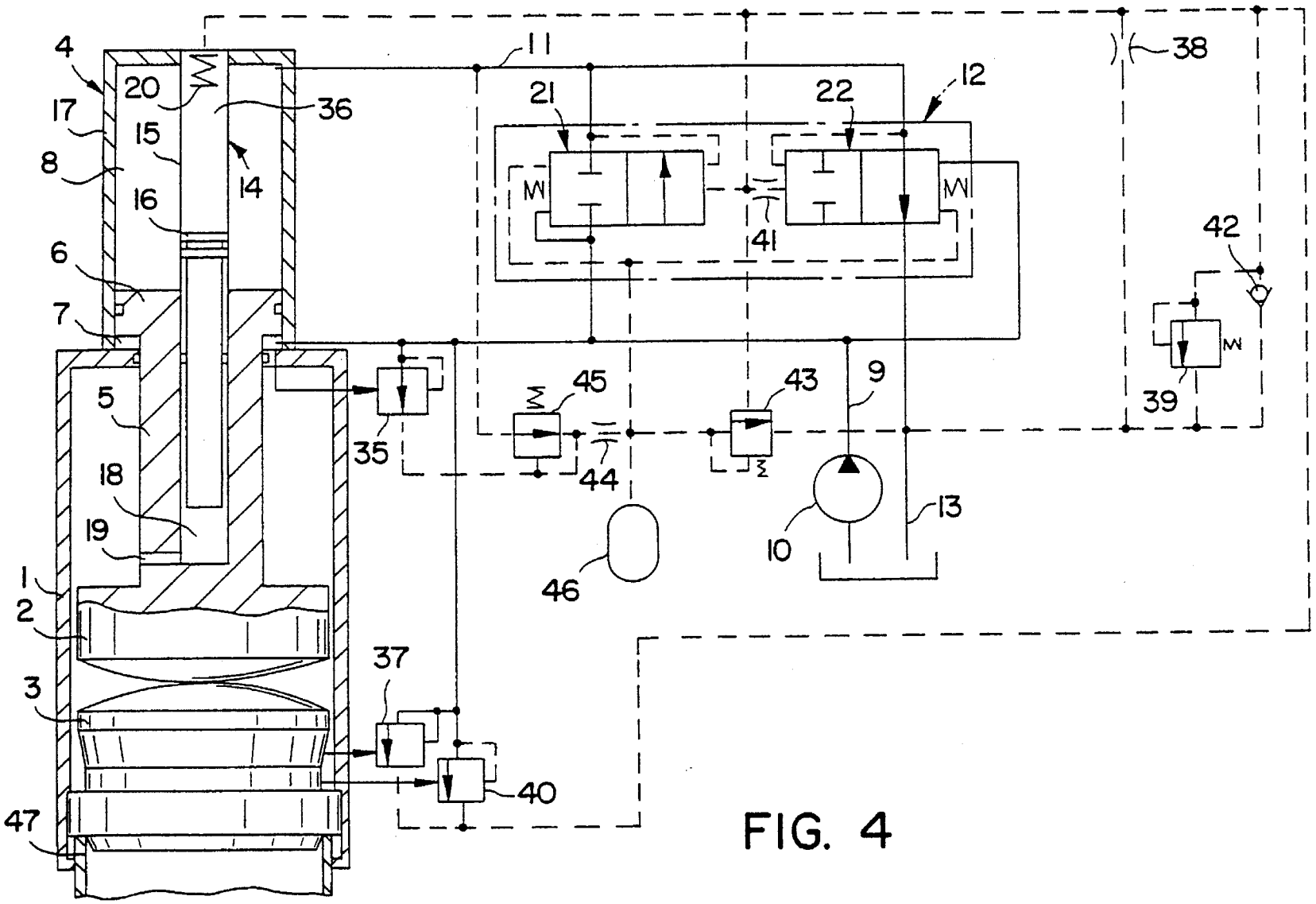
FIG. 4 is a view of FIG. 3, at the moment of re-reversal.

The re-reversal of the hydraulic directional control selector 12 takes place when the first control valve 35 (FIG. 4) operates.

The piston 6, while moving downwards prior to the collision of the striker 2 and the anvil block 3, interacts with the first control valve 35, which consequently brings the pressure line 9 in communication with the pilot chamber of the fourth control valve 45 and opens it, and through the third throttle 44, establishes communication with the first pair of the pilot chambers 31, 34 (FIG. 2) of the valves 21, 22 to which the hydraulic accumulator 46 (FIG. 4) is connected.

Thus, said chambers 31, 34 (FIG. 2) of the directional control selector 12 (FIG. 4) are simultaneously brought in communication with the pressure line 9 through the first control valve 35, wherein the working pressure holds at that instant the fourth control valve 45 in the open position. If with the piston 6 deflected the first control valve 35 opens and the chambers 31, 34 (FIG. 2) of the valves 21, 22 remain under pressure, which ensures their changing over irrespective of the position assumed by the piston 6 (FIG. 4) of the power cylinder 4.

After the hydraulic accumulator 46 has been charged to a definite pressure, the valves 21 and 22 operate alternately due to a difference between the cross-sectional areas of the first pair of the pilot chambers 31 (FIG. 2) and 34 of the valves 21 and 22, and also due to different blocking forces acting on the valves 21, 22. The hydraulic accumulator 46 (FIG. 4) is discharged once the valves have been operated in the following sequence: the third throttle 44—the fourth control valve 45—the second valve 22, and after the third control valve 43 has operated, directly through the latter.

It is by selecting the cross-sectional area of the third throttle 44 and the capacity of the hydraulic accumulator 46 that there is monitored the instant of changing over the first and the second valves 21 and 22 into the position where the head end 8 (FIG. 1) communicates with the return flow line 13, the change over rate of the second valve 22 being adjusted by the cross-sectional area of the second throttle 41.

An automatic mode of adjusting the impact energy is effected with the aid of the pressure relief valve 39 arranged in parallel with the first throttle 38. In this case, in the course of upward reversal, a portion of the fluid flows from the chamber 36 of the pilot cylinder 15 through the first throttle 38, with the result that with each cycle the plunger 16 of the pilot cylinder 15 occupies the position higher than the previous one, whereby the piston 6 with the rod 5 rises still higher with each succeeding cycle, thus increasing the impact energy. This goes on until the hydraulic device reaches the maximum impact energy, or the driving depth of a pile 47 gains the optimum value.

When operating under the conditions of maximum impact energy-, the plunger 16 of the pilot cylinder 15 compresses the spring 20, thus forcing the working fluid out from the chamber 36 of the pilot cylinder 15. When the rod 5 along with the piston 6 moves downwards, the plunger 16 actuated by the compressed spring 20 moves downwards under the action of the spring 20, thus drawing in liquid from the return flow line 13 through the non-return valve 42. The plunger 16 assumes a definite position and returns to this position after each cycle.

When the driving depth of the pile 47 per stroke reaches the optimum value, the second control valve 37 operates to feed a portion of the fluid into the chamber 36 of the pilot cylinder 15, and causes the plunger 16 of the pilot cylinder 15 to move downwards, whereby the piston stroke and hence the impact energy decreases. Then the fluid is drawn off again from the chamber 36 of the pilot cylinder 15, until the volume of the drained fluid and that of the fluid supplied are equalized, which means that an optimum impact energy is established for the given pile 47.

In case the driving depth of the pile 47 exceeds the permissible amount, the second control valve 37 operates together with the emergency valve 40, and the chamber 36 of the pilot cylinder 15 is completely filled with the working fluid, whereby the hydraulic device starts to operate with a minimum impact energy.

Figure 5:
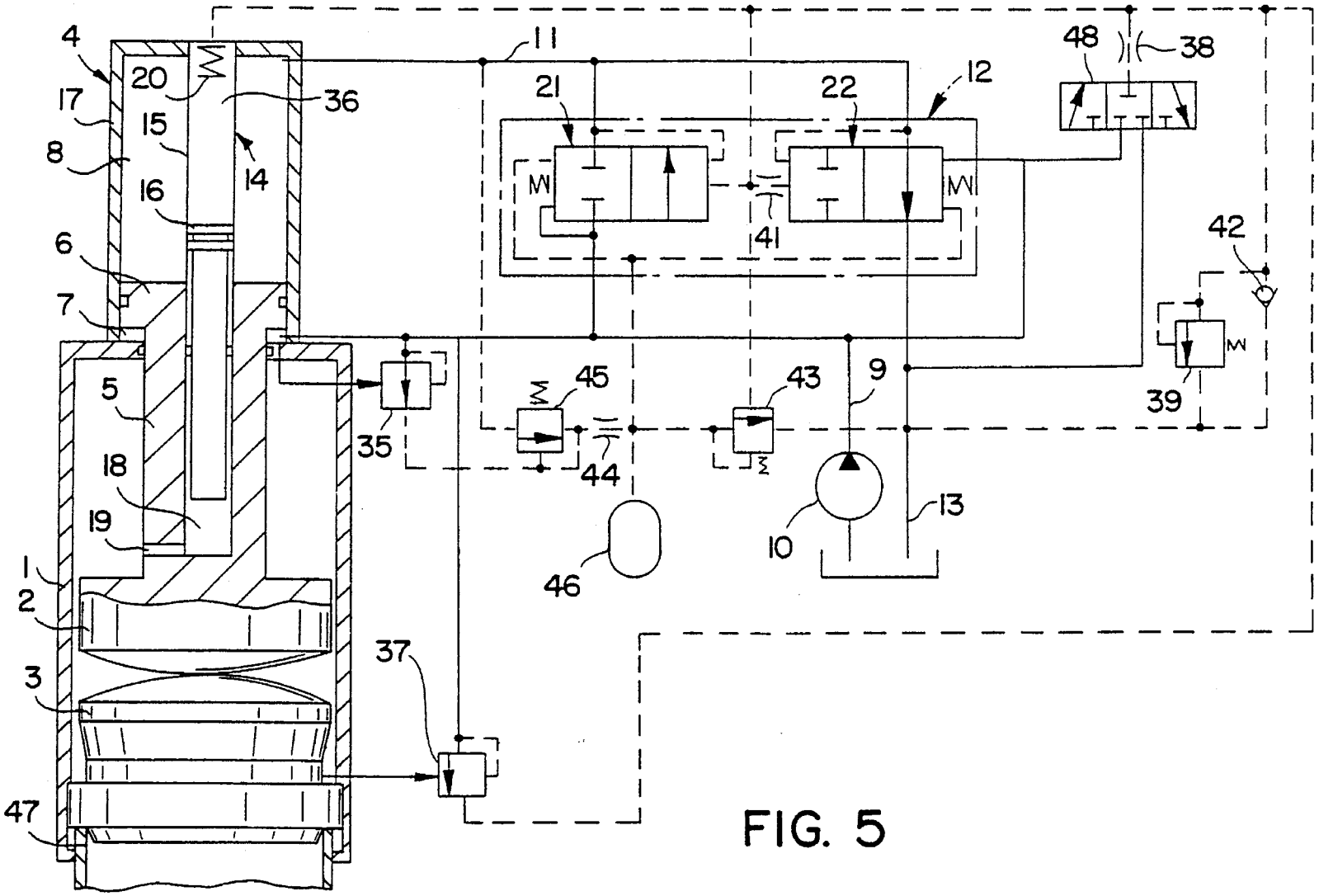
FIG. 5 shows the manual operation of the pile device, according to the invention, while in the initial position.

The hydraulic device is provided with an additional hydraulic directional control selector 48 (FIG. 5) mounted downstream from first throttle 38 and bringing the chamber 36 of the pilot cylinder 15 in communication with the return flow line 13 and the pressure line 9. When use is made of a combined automatic and manual adjustment of the impact energy, the operator can intervene in the operation of the device by varying the impact energy, so as to increase or decrease it, if required.

INDUSTRIAL APPLICABILITY

The invention can find most utility when used in coastal construction works and on the sea shelf where the environmental contamination is quite undesirable or inadmissible.

We claim:

1. A hydraulic device for driving piles, comprising:

a housing and a striker reciprocating within said housing;

an anvil block disposed within said housing coaxially with said striker and adapted to contact said striker;

a hydraulic directional control selector including (i) a first valve with a first pilot chamber and a second pilot chamber, (ii) a second valve with a first pilot chamber and a second pilot chamber, and (iii) a control unit having a pilot cylinder and a plunger;

a hydraulic pressure line, a return flow line and a pressure relief valve;

a hydraulic power cylinder having a rod with a first and a second end disposed on said housing coaxially with said striker;

a piston disposed within said hydraulic power cylinder and separating said hydraulic power cylinder into a rod end and a head end, said rod end permanently communicating with said hydraulic pressure line, said head end alternately communicating with said rod end and said return flow line via said hydraulic directional control selector;

said first end of said rod being connected to said striker and said second end being connected to said piston;

said control unit being separated from said hydraulic directional control selector and mounted on said housing coaxially with said striker;

said pilot cylinder having a chamber communicating with said return flow line via said pressure relief valve;

said plunger reciprocating within said chamber and having an end for interacting with said rod;

a first control valve interacting with said piston at an end of a working stroke of said piston;

said first valve connecting said head end to said rod end;

said second valve connecting said head end to said return flow line;

said first pilot chambers (i) communicating with each other, (ii) closing said first valve and opening said second valve, and (iii) communicating with said return flow line and said hydraulic pressure line via said first control valve;

said second pilot chambers (i) communicating with each other, (ii) opening said first valve and closing said second valve, and (iii) communicating with said chamber of said pilot cylinder.

2. The hydraulic device of claim 1, wherein said first pilot chamber of said first valve has a cross-sectional area which is larger than a cross-sectional area of said first pilot chamber of said second valve; and said second pilot chamber of said second valve has a cross-sectional area which is larger than a cross-sectional area of said second pilot chamber of said first valve.

3. The hydraulic device of claim 1, comprising:

a first throttle arranged in parallel to said pressure relief valve; and a second control valve for interacting with said anvil block;

said chamber of said pilot cylinder communicating with (i) said return flow line via said first throttle, and (ii) said hydraulic pressure line via said second control valve.

4. The hydraulic device of claim 3, comprising an emergency valve arranged parallel to said second control valve for interacting with said anvil block.

5. The hydraulic device of claim 3, comprising an additional hydraulic directional control selector arranged in series with said first throttle and communicating with said pilot cylinder and said return flow line.

6. The hydraulic device of claim 1, comprising:

a third control valve having a pilot chamber communicating with said chamber of said pilot cylinder, said third control valve communicating with both of said first pilot chambers and said return flow line.

7. The hydraulic device of claim 10, comprising:

a second throttle communicating with said second pilot chamber of said second valve and said chamber of said pilot cylinder;

a fourth control valve having a pilot chamber communicating with said hydraulic pressure line through said first control valve; and a third throttle arranged in series with said fourth control valve;

both of said first pilot chambers communicating with said head end via said fourth control valve and said third throttle.

8. The hydraulic device of claim 1, wherein said pilot cylinder includes an inner end face, an inlet port, and a spring disposed on said inner end face facing said inlet port;

wherein said device comprises a check valve communicating with said chamber and said return flow line.

* * * * *